US011293460B2

(12) United States Patent
Quan et al.

(10) Patent No.: US 11,293,460 B2
(45) Date of Patent: Apr. 5, 2022

(54) ENGINEERING MACHINERY HYDRAULIC SYSTEM

(71) Applicant: Taiyuan University of Technology, Taiyuan (CN)

(72) Inventors: Long Quan, Taiyuan (CN); Bo Wang, Taiyuan (CN); Lei Ge, Taiyuan (CN); Xiangyu Wang, Taiyuan (CN); Zepeng Li, Taiyuan (CN); He Liu, Taiyuan (CN)

(73) Assignee: TAIYUAN UNIVERSITY OF TECHNOLOGY, Taiyuan (CN)

( * ) Notice: Subject to any disclaimer, the term of this patent is extended or adjusted under 35 U.S.C. 154(b) by 44 days.

(21) Appl. No.: 16/715,679

(22) Filed: Dec. 16, 2019

(65) Prior Publication Data

US 2020/0208378 A1 Jul. 2, 2020

(30) Foreign Application Priority Data

Dec. 26, 2018 (CN) ..... 201811600428.4

(51) Int. Cl.

| | |
|---|---|
| ***F15B 11/16*** | (2006.01) |
| ***E02F 9/22*** | (2006.01) |
| ***F15B 13/04*** | (2006.01) |
| *F15B 13/044* | (2006.01) |
| *F15B 13/02* | (2006.01) |

(52) U.S. Cl.

CPC ..... *F15B 11/163* (2013.01); *E02F 9/2296* (2013.01); *F15B 13/0417* (2013.01); *E02F 9/2225* (2013.01); *E02F 9/2235* (2013.01); *F15B 13/026* (2013.01); *F15B 13/044* (2013.01); *F15B 13/0444* (2013.01); *F15B 2211/20546* (2013.01); *F15B 2211/30535* (2013.01); *F15B 2211/30555* (2013.01);

(Continued)

(58) Field of Classification Search

None

See application file for complete search history.

(56) References Cited

U.S. PATENT DOCUMENTS 4,870,819 A * 10/1989 Walzer ..... G05D 16/2097 60/422
5,150,574 A * 9/1992 Hirata ..... F15B 13/0417 60/465

(Continued)

FOREIGN PATENT DOCUMENTS

JP 06213204 A * 8/1994
JP 07103204 A * 4/1995

OTHER PUBLICATIONS

JP H07103204 A machine translation to English (Year: 1995).*
JP H06213204 A machine translation to English (Year: 1994).*

*Primary Examiner* — F Daniel Lopez
*Assistant Examiner* — Michael Quandt
(74) *Attorney, Agent, or Firm* — Cooper Legal Group, LLC

(57) ABSTRACT

The present invention provides an engineering machinery hydraulic system with compensation differential pressure controllable, uses an electronic pressure compensating valve to solve the problem of flow mismatch under conditions of pressure over-limit and flow saturation, and realizes proportional shunt control and high-precision flow distribution of the system. The engineering machinery hydraulic system disclosed in the present invention has the advantages of low energy consumption, fast response speed, and high flow control precision.

12 Claims, 6 Drawing Sheets

(52) U.S. Cl.
CPC ..... *F15B 2211/3144* (2013.01); *F15B 2211/6054* (2013.01); *F15B 2211/6313* (2013.01)

(56) References Cited

U.S. PATENT DOCUMENTS 5,159,812 A * 11/1992 Nikolaus ..... G05D 7/0688 60/445
9,200,646 B2 * 12/2015 Weickert ..... F15B 11/163

* cited by examiner

ENGINEERING MACHINERY HYDRAULIC SYSTEM

RELATED APPLICATION

The present application claims priority to Chinese Patent Application 201811600428.4, filed on Dec. 26, 2018, which is incorporated herein by reference.

TECHNICAL FIELD

The present invention belongs to the field of hydraulic technologies, and in particular, to an engineering machinery hydraulic system.

BACKGROUND

As important equipment for national infrastructure construction, engineering machinery has been widely used in various fields such as construction, transportation, water conservancy, mining and national defense. Statistically, the holding number of engineering machinery in China was about 7.4 million up to end of 2017. The engineering machinery industry has become an important pillar industry in China and plays an important role in national economy, energy production and construction of important projects.

During operation of various types of engineering machinery, when operation conditions are complicated, sometimes it is necessary to control multiple actions of multiple actuators to complete some complicated actions. Therefore, how to properly distribute flows according to a desired motion relationship of each actuator is particularly important. In a solution of the prior art, the load-sensitive technology is widely used in the engineering machinery hydraulic system due to the advantages of simple circuit, high energy efficiency, good operability and the like. The basic principle is to detect a highest load pressure, and use this pressure value as a control signal of a variable pump to change the displacement of a hydraulic pump, so that outlet pressure of the pump is always a constant value higher than the highest load pressure, thus effectively reducing bypass loss. At the same time, a pressure compensating valve is added to each actuator control valve to keep the pressure difference between a front control valve opening and a rear control valve opening constant, so that the operating speed of the actuator is only related to the size of the control valve opening, which improves the operability of the system when the multiple actions are performed by the multiple actuators.

However, for a traditional load-sensitive system, the pressure difference of the compensating valve remains constant. Under conditions of flow saturation and pressure over-limit, the pressure compensating valve is out of function, and the operating speed of each actuator is not uncontrolled. At the same time, the load-sensitive system based on differential pressure control needs to detect the load pressure, and the system has problems related to response lag and poor stability, which makes it difficult to meet the requirements of high-precision flow distribution and micro-motion precise-positioning operation.

SUMMARY

To resolve the foregoing problems, the present invention aims to provide an engineering machinery hydraulic system with compensation differential pressure controllable, matches the operating pressure difference in real time according to different operating conditions, solves the problem of flow mismatch under conditions of pressure over-limit and flow saturation, and realizes proportional shunt control and high-precision flow distribution of the system.

To achieve the above purpose, the present invention adopts the following technical solution: The present invention provides an engineering machinery hydraulic system, including a power source, a main hydraulic pump, an overflow valve, an oil inlet passage, an overflow detection valve, an oil detection passage, an oil return passage, and a plurality of work connections, where the power source drives the main hydraulic pump to operate, an oil outlet of the main hydraulic pump is connected with the oil inlet passage and an oil inlet of the overflow valve, an oil outlet of the overflow valve is connected with an oil tank, the plurality of work connections are respectively connected with the oil inlet passage, the oil return passage and the oil detection passage, the oil detection passage is connected with the oil return passage through the overflow detection valve, and the oil return passage is connected with the oil tank; and further including a controller and an electronic pressure compensating valve, where the electronic pressure compensating valve may be a proportional electromagnet controlled pressure compensating valve, a linear motor controlled pressure compensating valve, or a rotating motor driven and ball screw controlled pressure compensating valve; when the electronic pressure compensating valve is a proportional electromagnet controlled pressure compensating valve, the electronic pressure compensating valve includes a displacement sensor, a proportional electromagnet, a compensating valve body, a compensating valve core, a spring, an oil inlet, an oil outlet, a first control chamber and a second control chamber, where the compensating valve core is arranged in the compensating valve body; a first end of the spring acts on a left end face of the compensating valve core, and a second end of the spring acts on the compensating valve body and forms the first control chamber with the compensating valve core; the proportional electromagnet is connected with the compensating valve body, acts on a right end face of the compensating valve core, and forms the second control chamber with the compensating valve core and the compensating valve body; the displacement sensor is integrated with the proportional electromagnet, and signal terminals of the proportional electromagnet and the displacement sensor are respectively connected with the controller;

when the electronic pressure compensating valve is a linear motor controlled pressure compensating valve, the electronic pressure compensating valve includes a displacement sensor, a compensating valve body, a compensating valve core, a spring, a linear motor, an oil inlet, an oil outlet, a first control chamber and a second control chamber, where the compensating valve core is arranged in the compensating valve body; a first end of the spring acts on a left end face of the compensating valve core, and a second end of the spring acts on the compensating valve body and forms the first control chamber with the compensating valve core; the displacement sensor is disposed on the compensating valve core through the compensating valve body to directly detect a position and a velocity of the compensating valve core; the linear motor is connected with the compensating valve body, is disposed on a right end face of the compensating valve core, and forms the second control chamber with the compensating valve body and the compensating valve core; and signal terminals of the displacement sensor and the linear motor are respectively connected with the controller;

when the electronic pressure compensating valve is a rotating motor driven and ball screw controlled pressure compensating valve, the electronic pressure compensating valve includes a displacement sensor, a compensating valve body, a compensating valve core, a spring, a rotating motor, a ball screw, a connecting rod, an oil inlet, an oil outlet, a first control chamber and a second control chamber, where the compensating valve core is arranged in the compensating valve body; a first end of the spring acts on a left end face of the compensating valve core, and a second other end of the spring acts on the compensating valve body and forms the first control chamber with the compensating valve core; the displacement sensor is disposed on the compensating valve core through the compensating valve body to directly detect a position and a velocity of the compensating valve core; the rotating motor is connected with the compensating valve body and forms the second control chamber with the compensating valve body and the compensating valve core; an extension shaft of the rotating motor is connected with a screw of the ball screw, and a nut of the ball screw is connected with the connecting rod; the rotating motor drives the ball screw to rotate, where rotary motion of the rotating motor is converted into a linear motion by the ball screw, thereby driving the connecting rod to output different forces and displacements; and signal terminals of the displacement sensor and the rotating motor are respectively connected with the controller; and a connection manner between the electronic pressure compensating valve and the system is as follows:

the electronic pressure compensating valve is arranged in the plurality of work connections and arranged in front of a reversing valve; the oil inlet of the electronic pressure compensating valve is connected with the oil inlet passage, the oil outlet of the electronic pressure compensating valve is connected with an oil inlet of a check valve and the second control chamber of the electronic pressure compensating valve, and the first control chamber of the electronic pressure compensating valve is connected with an oil detection opening of the reversing valve and connected with the oil detection passage through a shuttle valve; or the electronic pressure compensating valve is arranged in the plurality of work connections and arranged in rear of a reversing valve; an oil outlet of a check valve is connected with the oil inlet of the electronic pressure compensating valve and the second control chamber of the electronic pressure compensating valve, and the first control chamber of the electronic pressure compensating valve is directly connected with the oil detection passage, and, the oil outlet B of the electronic pressure compensating valve is connected with the oil detection opening of the reversing valve; or the oil inlet of the electronic pressure compensating valve is directly connected with the oil outlet of the main hydraulic pump and the second control chamber of the electronic pressure compensating valve, the oil outlet of the electronic pressure compensating valve is connected with the oil tank, and the first control chamber of the electronic pressure compensating valve is directly connected with the oil detection passage.

The electronic pressure compensating valve is one of a normally open type or a normally closed type.

The displacement sensor is integrated on the proportional electromagnet, and the position and the velocity of the compensating valve core are detected by detecting the proportional electromagnet; or the displacement sensor is disposed on the compensating valve core to directly detect the position and the velocity of the compensating valve core.

The proportional electromagnet is one of a unidirectional proportional electromagnet or a bidirectional proportional electromagnet.

The rotating motor is one of a direct current (DC) motor, a synchronous motor, or an asynchronous motor.

The main hydraulic pump is one of a mechanical load-sensitive pump, an electronic proportional pressure pump, or an electronic proportional variable displacement pump.

The power source is one of an engine or an electric motor.

The reversing valve is one of an electronic proportional reversing valve, a hydraulically controlled reversing valve, or an electro-hydraulic controlled reversing valve.

The actuator is one of a hydraulic cylinder or a hydraulic motor.

The engineering machinery hydraulic system further includes a first pressure sensor and a second pressure sensor; and a pressure end of the first pressure sensor is connected with the oil inlet passage, a pressure end of the second pressure sensor is connected with the oil detection passage, and signal terminals of the first pressure sensor and the second pressure sensor are respectively connected with the controller.

The engineering machinery hydraulic system includes a plurality of oil inlet passages, and the plurality of oil inlet passages are in communication with each other through a confluence control valve to perform shunt and confluence control.

The present invention has the following beneficial effects as compared with the prior art.

The present invention designs a novel component electronic pressure compensating valve, which has the function of real-time regulation of the compensating differential pressure, can realize the arbitrary proportional shunt and anti-flow saturation control of the system, and effectively solves the problem of system flow mismatch of the load-sensitive technology under the operating conditions of flow saturation and pressure over-limit.

The present invention uses a novel component electronic pressure compensating valve, which increases the control range of the system differential pressure, and matches the compensating differential pressure based on the operating condition requirements. During fine operation, the compensating differential pressure of the pressure compensating valve is reduced, and flow gain of the valve port is reduced; and during quick motion, the compensating differential pressure of the pressure compensating valve is increased, and the flow gain of the valve port is increased to achieve quick response and efficient operation of the actuator.

The present invention has wide application range, can be applied to various control technologies, has strong technical advancement, not only can be applied to load-sensitive technologies based on differential pressure control, and also can be applied to flow matching control technologies based on compensating valve core displacement closed loop. The present invention can also integrate the load-sensitive and flow-matched pressure flow combined control into one, realizes the real-time matching control mode based on the operation condition requirements, and uses a pressure control manner under the operation condition of rapid and large differential load to improve system working efficiency. Under slow and fixed load conditions, a flow control manner is adopted to meet the requirements of high-precision flow distribution and fine-motion precise positioning operations.

In the figures: 1 represents a power source, 2 represents a main hydraulic pump, 3 represents an overflow valve, 4 represents an oil inlet passage, 5 represents an overflow detection valve, 6 represents an oil detection passage, 7 represents an oil return passage, 8 represents a work connection, 9 represents a controller, 10 represents an electronic pressure compensating valve, 11 represents a shuttle valve, 12 represents a check valve, 13 represents reversing valve, 14 represents a first one-way overflow valve, 15 represents a second one-way overflow valve, 16 represents an actuator, 17 represents a displacement sensor, 18 represents a proportional electromagnet, 19 represents a compensating valve body, 20 represents a compensating valve core, 21 represents a spring, 22 represents a linear motor, 23 represents a rotating motor, 24 represents a ball screw, 25 represents a connecting rod, 26 represents a first pressure sensor, 27 represents a second pressure sensor, 28 represents a driving body, 29 represents a rotary body, 30 represents a movable arm, 31 represents a bucket rod, 32 represents a bucket, 33 represents a confluence control valve, 34 represents a first hydraulic circuit, and 35 represents a second hydraulic circuit.

DETAILED DESCRIPTION

The present invention will be explained in detail with reference to the attached FIG. 1-9.

Embodiment 1

Figure 1:
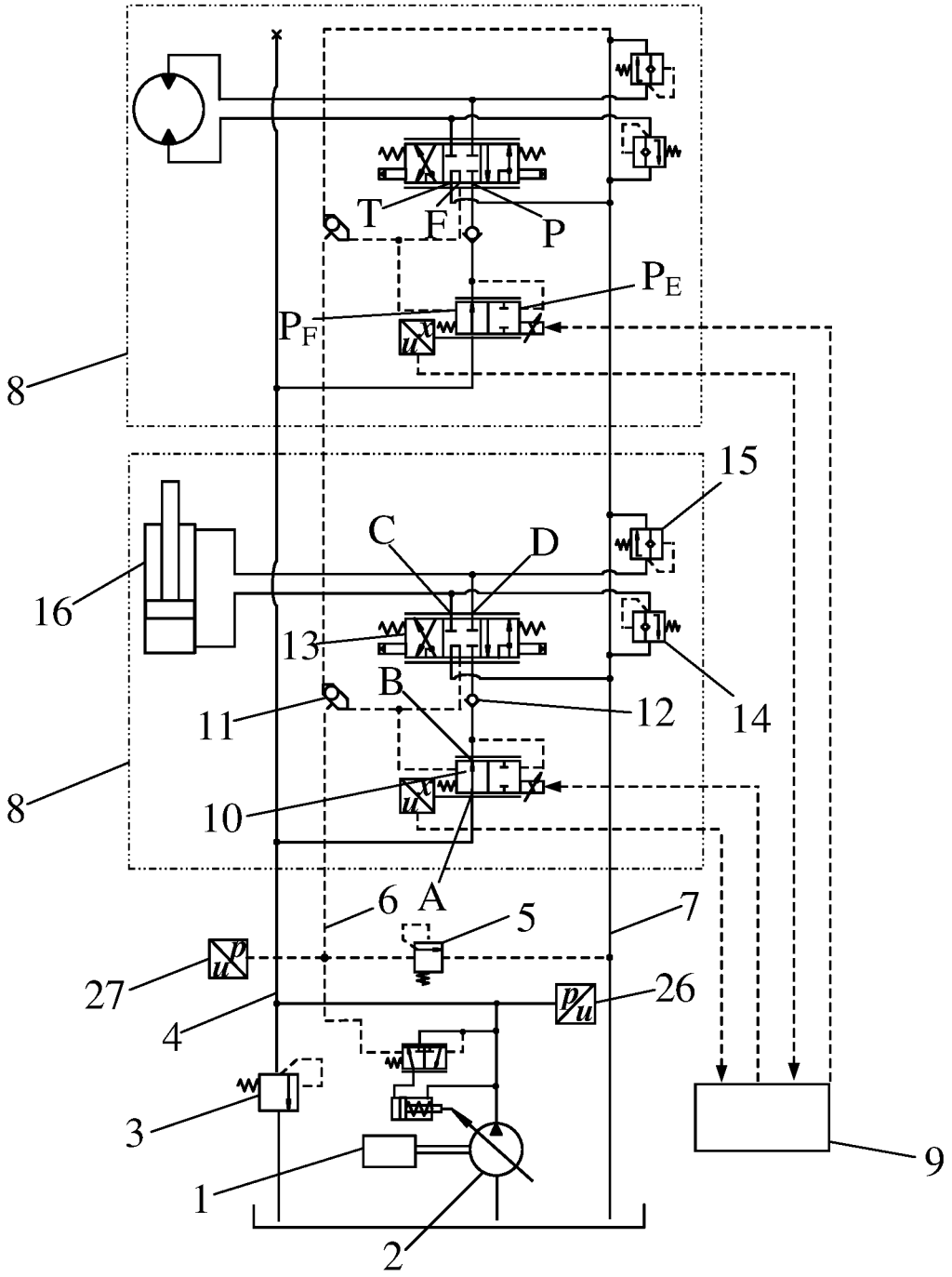
FIG. 1 is a system principle diagram of Embodiment 1 according to the present invention.

As shown in FIG. 1, an engineering machinery hydraulic system includes a power source 1, a main hydraulic pump 2, an overflow valve 3, an oil inlet passage 4, an overflow detection valve 5, an oil detection passage 6, an oil return passage 7, and a plurality of work connections 8. The power source 1 drives the main hydraulic pump 2 to operate, an oil outlet of the main hydraulic pump 2 is connected with the oil inlet passage 4 and the oil inlet of the overflow valve 3, an oil outlet of the overflow valve 3 is connected with an oil tank, the plurality of work connections 8 are respectively connected with the oil inlet passage 4, the oil return passage 7 and the oil detection passage 6, the oil detection passage is connected with the oil return passage through the overflow detection valve, and the oil return passage is connected with the oil tank. The hydraulic system further includes a controller 9 and an electronic pressure compensating valve 10.

The electronic pressure compensating valve 10 is arranged in the work connection 8 and arranged in the front of a reversing valve 13, the oil inlet A of the electronic pressure compensating valve 10 is connected with the oil inlet passage 4, the oil outlet B of the electronic pressure compensating valve 10 is connected with an oil inlet of a check valve 12 and the second control chamber $P_E$ of the electronic pressure compensating valve 10, and the first control chamber $P_F$ of the electronic pressure compensating valve 10 is connected with an oil detection opening F of the reversing valve 13 and connected with the oil detection passage 6 through a shuttle valve 11.

The electronic pressure compensating valve 10 is a proportional electromagnet 18 controlled pressure compensating valve or a linear motor 22 controlled pressure compensating valve or a rotating motor 23 driven and ball screw 24 controlled pressure compensating valve.

Figure 2:
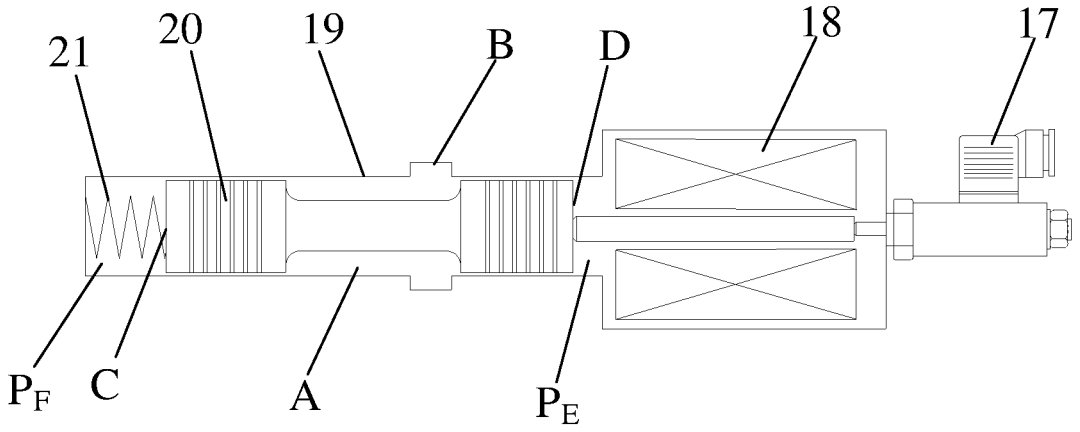
FIG. 2 is a first structural schematic diagram of an electronic pressure compensating valve according to the present invention.

As shown in FIG. 2, the electronic pressure compensating valve 10 is a proportional electromagnet 18 controlled pressure compensating valve, including a displacement sensor 17, a proportional electromagnet 18, a compensating valve body 19, a compensating valve core 20, a spring 21, an oil inlet A, an oil outlet B, a first control chamber $P_F$, and a second control chamber $P_E$. The compensating valve core 20 is arranged in the compensating valve body 19; one end of the spring 21 acts on a left end face C of the compensating valve core 20, and the other end acts on the compensating valve body 19 and forms the first control chamber $P_F$ with the compensating valve core 20; the proportional electromagnet 18 is connected with the compensating valve body 19, acts on a right end face D of the compensating valve core 20, and forms the second control chamber $P_E$ with the compensating valve core 20 and the compensating valve body 19; and the displacement sensor 17 is integrated with the proportional electromagnet 18, and signal terminals of the proportional electromagnet 18 and the displacement sensor 17 are respectively connected with the controller 9.

Figure 3:
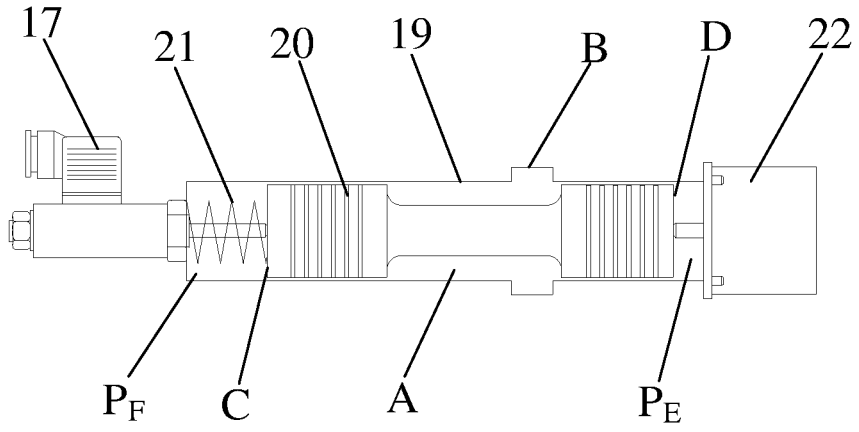
FIG. 3 is a second structural schematic diagram of an electronic pressure compensating valve according to the present invention.

As shown in FIG. 3, the electronic pressure compensating valve 10 is a linear motor 22 controlled pressure compensating valve, including a displacement sensor 17, a compensating valve body 19, a compensating valve core 20, a spring 21, a linear motor 22, an oil inlet A, an oil outlet B, a first control chamber $P_F$, and a second control chamber $P_E$. The compensating valve core 20 is arranged in the compensating valve body 19; one end of the spring 21 acts on a left end face C of the compensating valve core 20, and the other end acts on the compensating valve body 19 and forms the first control chamber $P_F$ with the compensating valve core 20; the displacement sensor 17 is disposed on the compensating valve core 20 through the compensating valve body 19 to directly detect a position X and a velocity XV of the valve core; the linear motor 22 is connected with the compensating valve body 19, is disposed on a right end face D of the compensating valve core 20, and forms the second control chamber $P_E$ with the compensating valve body 19 and the compensating valve core 20; and signal terminals of the displacement sensor 17 and the linear motor 22 are respectively connected with the controller 9.

Figure 4:
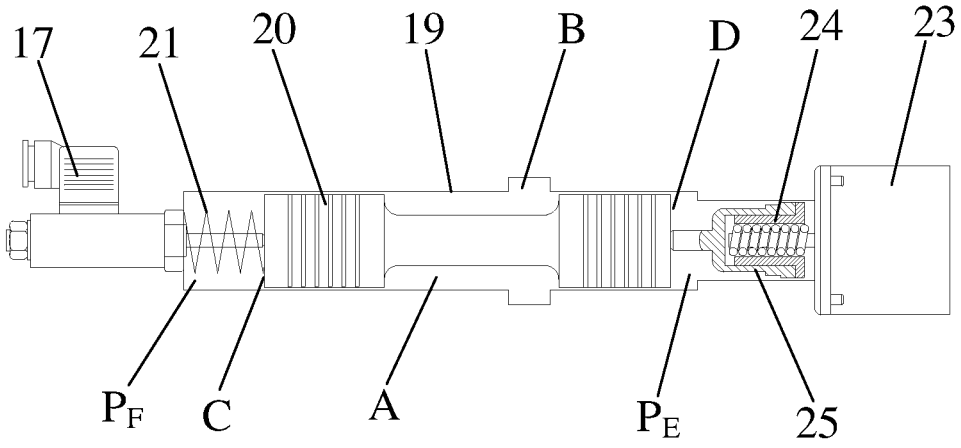
FIG. 4 is a third structural schematic diagram of an electronic pressure compensating valve according to the present invention.

As shown in FIG. 4, the electronic pressure compensating valve 10 is a rotating motor 23 driven and ball screw 24 controlled pressure compensating valve, including a displacement sensor 17, a compensating valve body 19, a compensating valve core 20, a spring 21, a rotating motor 23, a ball screw 24, a connecting rod 25, an oil inlet A, an oil outlet B, a first control chamber $P_F$, and a second control chamber $P_E$. The compensating valve core 20 is arranged in the compensating valve body 19; one end of the spring 21 acts on a left end face C of the compensating valve core 20, and the other end acts on the compensating valve body 19 and forms the first control chamber $P_F$ with the compensating valve core 20; the displacement sensor 17 is disposed on the compensating valve core 20 through the compensating valve body 19 to directly detect a position X and a velocity XV of the valve core; the rotating motor 23 is connected with the compensating valve body 19 and forms the second control chamber $P_E$ with the compensating valve body 19 and the compensating valve core 20; an extension shaft of the rotating motor 23 is connected with a screw of the ball screw 24, and a nut of the ball screw 24 is connected with the connecting rod; the rotating motor 23 drives the ball screw 24 to rotate, where the rotary motion of the motor is converted into a linear motion by the ball screw 24, thereby driving the connecting rod 25 to output different forces and displacements; and signal terminals of the displacement sensor 17 and the rotating motor 23 are respectively connected with the controller 9.

The electronic pressure compensating valve 10 is one of a normally open type or a normally closed type.

The displacement sensor 17 is integrated on the proportional electromagnet 18, and detects the position X and the velocity XV of the valve core by detecting the proportional electromagnet 18; or is disposed on the compensating valve core 20 to directly detect the position X and the velocity XV of the valve core.

The proportional electromagnet 18 is one of a unidirectional proportional electromagnet or a bidirectional proportional electromagnet.

The rotating motor 23 is one of a DC motor, a synchronous motor, or an asynchronous motor.

The main hydraulic pump 2 is a mechanical load-sensitive pump.

The power source 1 is one of an engine or an electric motor.

The reversing valve 13 is one of an electronic proportional reversing valve, a hydraulically controlled reversing valve, or an electro-hydraulic controlled reversing valve.

The actuator 16 is one of a hydraulic cylinder or a hydraulic motor.

The engineering machinery hydraulic system further includes a first pressure sensor 26 and a second pressure sensor 27. A pressure end of the first pressure sensor 26 is connected with the oil inlet passage 4, a pressure end of the second pressure sensor 27 is connected with the oil detection passage 6, and signal terminals of the first pressure sensor 26 and the second pressure sensor 27 are respectively connected with the controller 9.

Embodiment 2

For the second implementation of the engineering machinery hydraulic system according to the present invention, its structural composition is the same as that of Embodiment 1. The difference is that the connection mode between the electronic pressure compensating valve 10 and the system is changed, and the main hydraulic pump 2 is an electronic proportional variable displacement pump.

Figure 5:
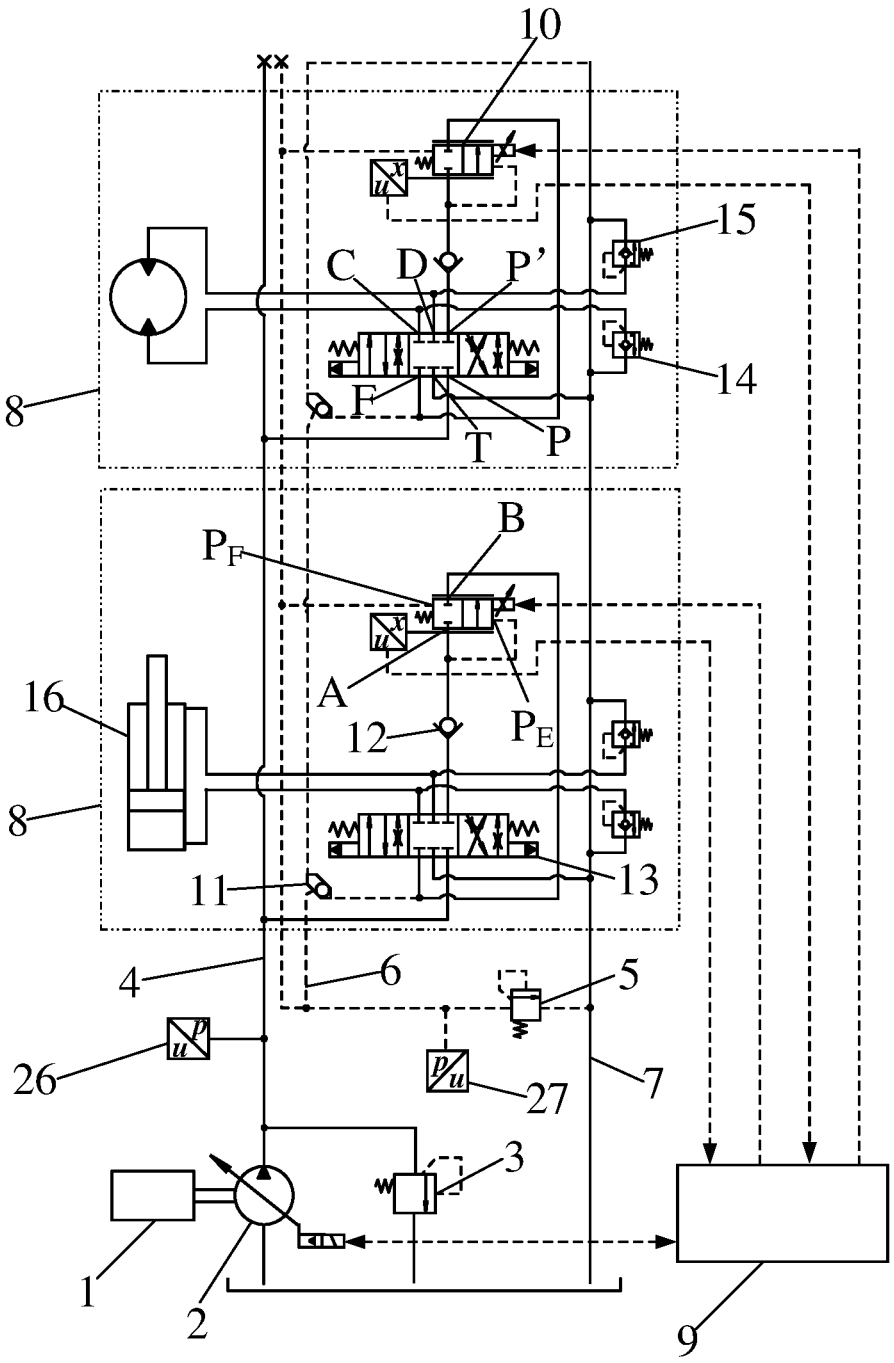
FIG. 5 is a system principle diagram of Embodiment 2 according to the present invention.

As shown in FIG. 5, the electronic pressure compensating valve 10 is arranged in the work connection 8 and arranged in the rear of a reversing valve 13; an oil outlet of a check valve 12 is connected with the oil inlet A of the electronic pressure compensating valve 10 and the second control chamber $P_E$ of the electronic pressure compensating valve 10, and the first control chamber $P_F$ of the electronic pressure compensating valve 10 is directly connected with the oil detection passage 6; and the oil outlet B of the electronic pressure compensating valve 10 is connected with an oil detection opening F of the reversing valve 13.

Embodiment 3

For the third implementation of the engineering machinery hydraulic system according to the present invention, its structural composition is the same as that of Embodiment 1. The difference is that the connection mode between the electronic pressure compensating valve 10 and the system is changed, and the main hydraulic pump 2 is an electronic proportional variable displacement pump.

Figure 6:
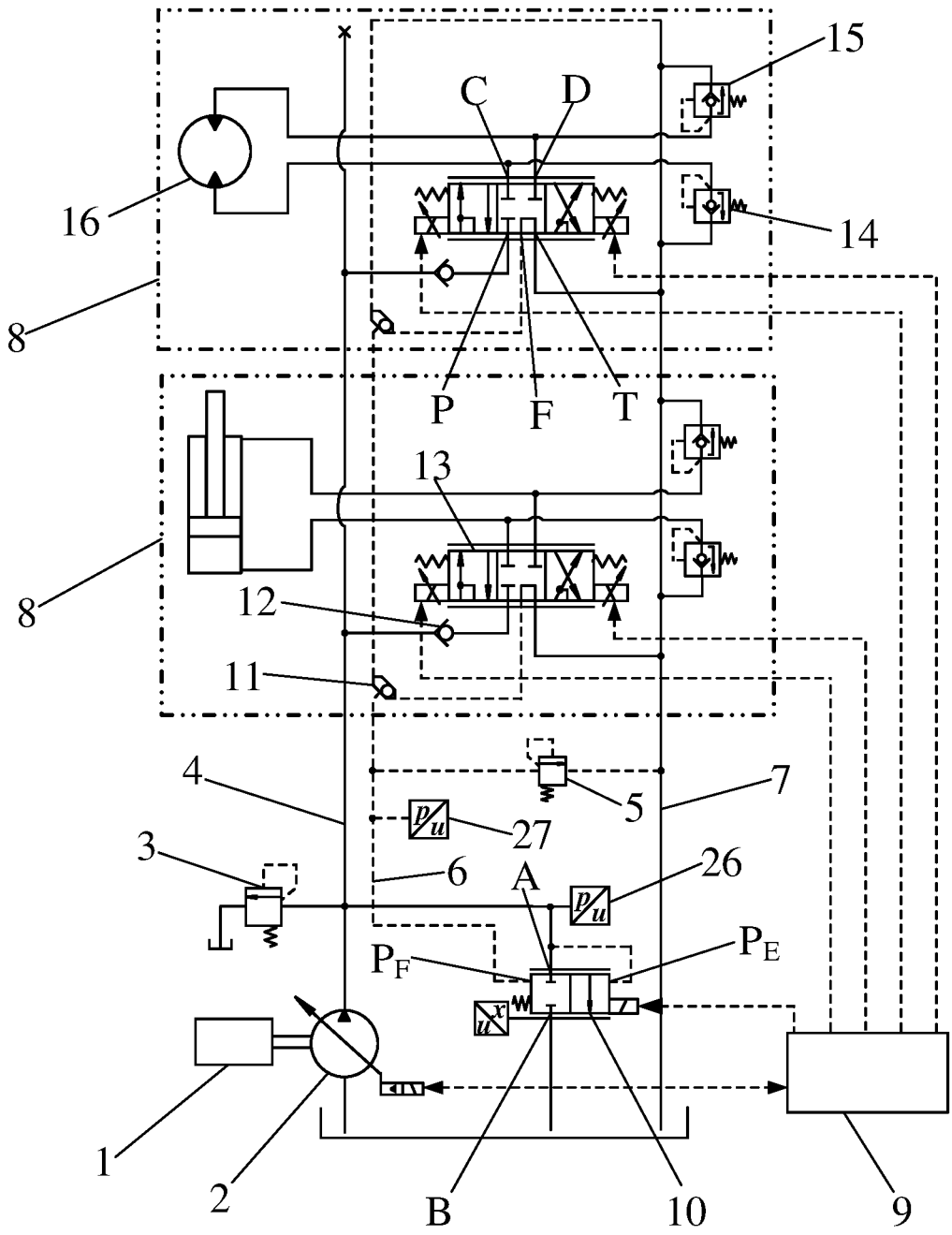
FIG. 6 is a system principle diagram of Embodiment 3 according to the present invention.

As shown in FIG. 6, the oil inlet A of the electronic pressure compensating valve 10 is directly connected with the oil outlet of the main hydraulic pump 2 and the second control chamber $P_E$ of the electronic pressure compensating valve 10, the oil outlet B of the electronic pressure compensating valve 10 is connected with the oil tank, and the first control chamber $P_F$ of the electronic pressure compensating valve 10 is directly connected with the oil detection passage 6.

Embodiment 4

For the fourth implementation of the engineering machinery hydraulic system according to the present invention, its connection mode is the same as that of Embodiment 1. The difference is that when the main hydraulic pump 2 is an electronic proportional variable displacement pump, the engineering machinery hydraulic system may not include an overflow detection valve 5, an oil detection passage 6, and a second pressure sensor 27; and the work connection 8 may not include a shuttle valve 11.

Figure 7:
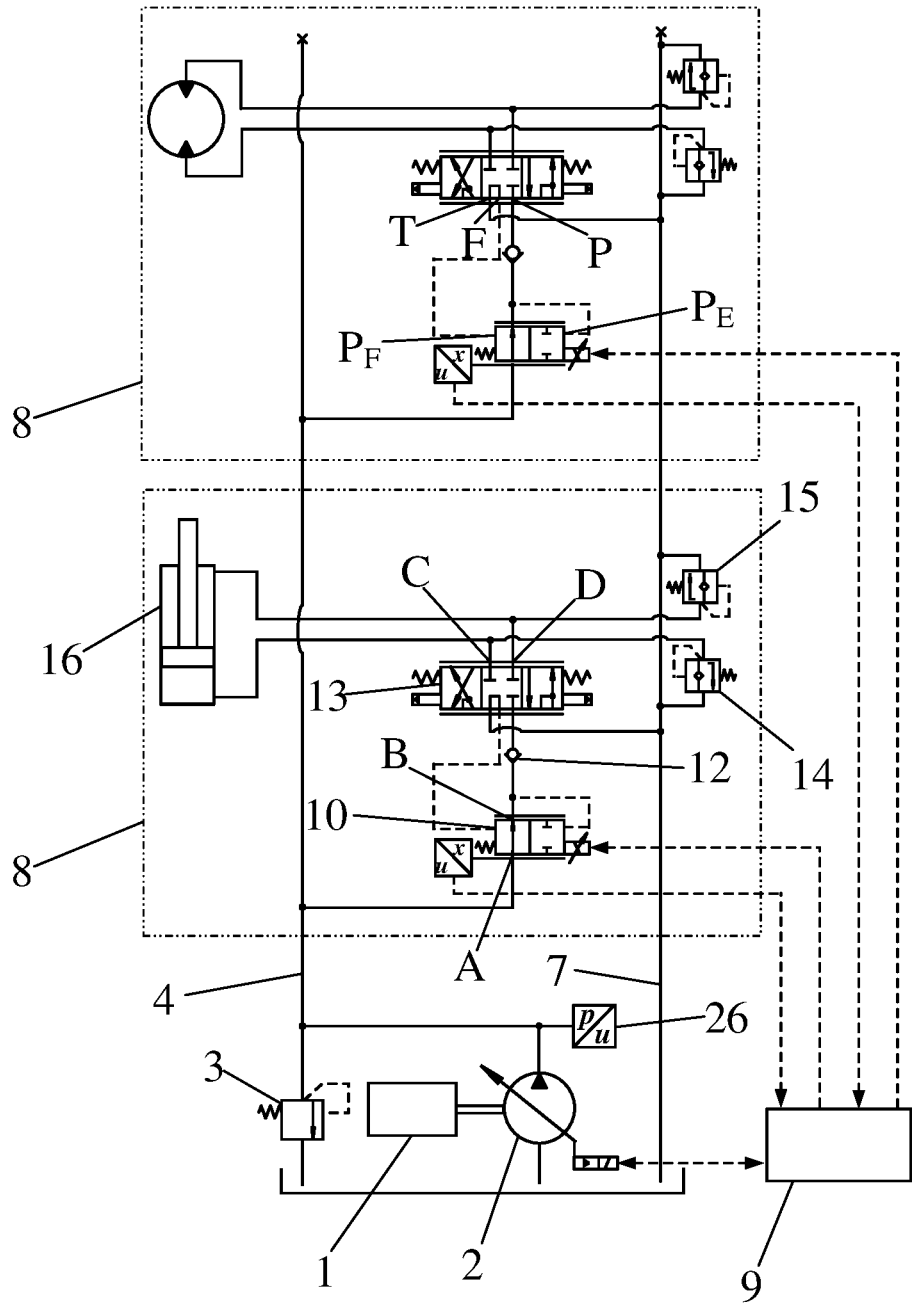
FIG. 7 is a system principle diagram of Embodiment 4 according to the present invention.

As shown in FIG. 7, the oil inlet A of the electronic pressure compensating valve 10 is connected with the oil inlet passage 4; the oil outlet B of the electronic pressure compensating valve 10 is connected with the oil inlet of the check valve 12 and the second control chamber $P_E$ of the electronic pressure compensating valve 10; the oil outlet of the check valve 12 is connected with the oil inlet P of the reversing valve 13; the oil outlet T of the reversing valve 13 is connected with the oil return passage 7; the oil detection opening F of the reversing valve 13 is connected with the first control chamber $P_F$ of the electronic pressure compensating valve 10; working ports C, D of the reversing valve 13 are respectively connected with the oil inlet of the first one-way overflow valve 14, the oil inlet of the second one-way overflow valve 15, and two working ports of the actuator 16; and the oil outlets of the first one-way overflow valve 14 and the second one-way overflow valve 15 are connected with the oil return passage 7.

Under this composition structure, the entire system can adopt a global flow matching control method. The displacement amount of each compensating valve core 20 is detected by the displacement sensor 17 and is compared with a maximum theoretical displacement amount; then, the displacement of the main hydraulic pump 2 is controlled so that the compensating valve core of any one of the electronic pressure compensating valves 10 has a maximum displacement amount; and at this time, the output flow of the main hydraulic pump 2 is the same as that the actuator 16 required, where pressure control that is prone to vibration is converted into the position control of the pump swing angle and finally converted into precise closed-loop control of the pump output flow, thereby improving the flow supply accuracy of the main hydraulic pump 2 and reducing the system pressure oscillation.

Embodiment 5

Figure 8:
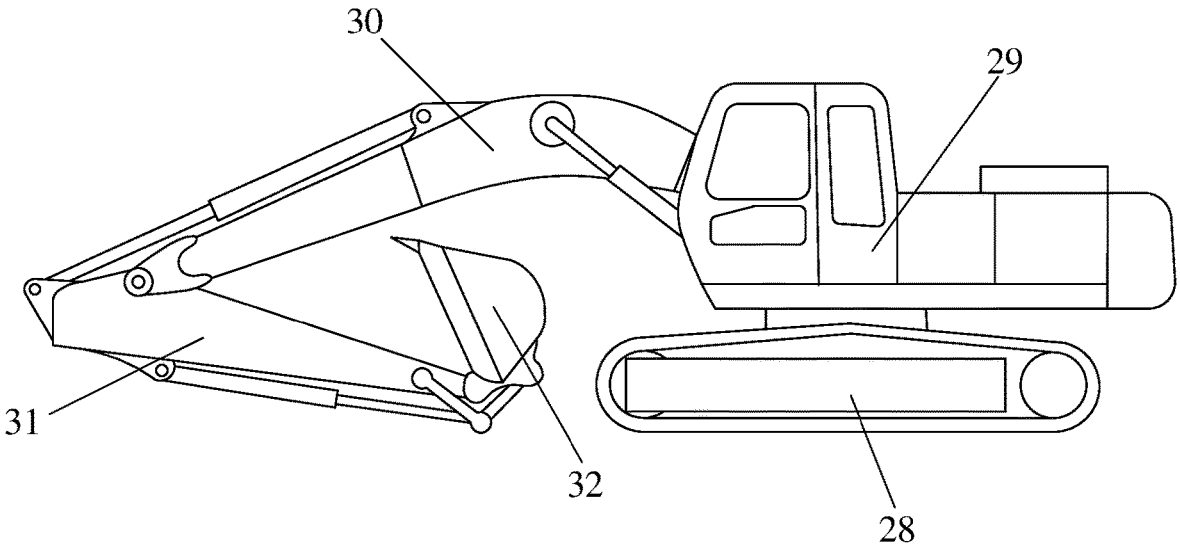
FIG. 8 is an operation device diagram of Embodiment 5 according to the present invention.

The excavator is typical multi-actuator engineering machinery, and its operation device is shown in FIG. 8, mainly including a driving body 28, a rotary body 29 disposed on the driving body 28, a movable arm 30 connected with the rotary body 29 and configured to rotate in the up and down direction, a bucket rod 31 mounted in the front end of the movable arm, and a bucket 32 mounted in the front of the bucket rod 31. During the operation, the excavator mainly operates the rotary body 29, the movable arm 30, the bucket rod 31 and the bucket 32 to perform a single action or a compound action to complete a task. In order to reduce throttling loss of the compensating valve caused by large load difference, the entire system is divided into a first hydraulic circuit 34 and a second hydraulic circuit 35 based on the load size of the actuator, and the oil inlet passages 4 of the two circuits may be communicated through a confluence control valve 33 to perform the shunt and confluence control.

Figure 9:
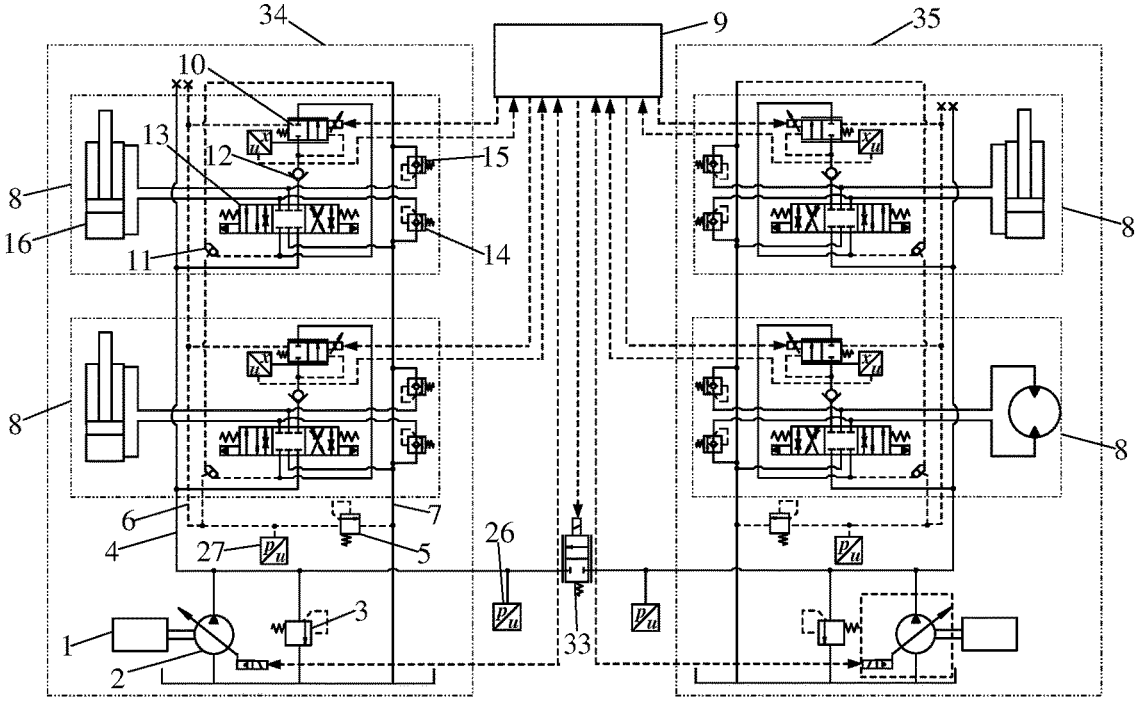
FIG. 9 is a system principle diagram of Embodiment 5 according to the present invention.

FIG. 9 shows a system principle diagram of a hydraulic excavator to which the present invention is applied, mainly including a first hydraulic circuit 34 and a second hydraulic circuit 35. The first hydraulic circuit 34 includes: a power source 1, a main hydraulic pump 2, an overflow valve 3, an oil inlet passage 4, an overflow detection valve 5, an oil detection passage 6, an oil return passage 7, two work connections 8, a controller 9, a first pressure sensor 26, and a second pressure sensor 27. The power source 1 is coaxially mechanically coupled with the main hydraulic pump 2, an oil suction port of the main hydraulic pump 2 is connected with an oil tank, an oil outlet of the main hydraulic pump 2 is connected with the oil inlet passage 4 and the oil inlet of the overflow valve 3, the oil outlet of the overflow valve 3 is connected with the oil tank, the oil detection passage 6 is connected with the oil inlet of the overflow detection valve 5, the overflow detection valve 5 is connected with the oil return passage 7, the oil return passage 7 is connected with the oil tank, the two work connections 8 are respectively connected with the oil inlet passage 4, the oil return passage 7 and the oil detection passage 6, a pressure end of the first pressure sensor 26 is connected with the oil inlet passage 4, a pressure end of the second pressure sensor 27 is connected with the oil detection passage 6, and signal terminals of the first pressure sensor 26 and the second pressure sensor 27 are respectively connected with the controller 9. The component of the second hydraulic circuit 35 is the same as that of the first hydraulic circuit 34.

The work connection 8 includes an electronic pressure compensating valve 10, a shuttle valve 11, a check valve 12, a reversing valve 13, a first one-way overflow valve 14, a second one-way overflow valve 15, and an actuator 16. The electronic pressure compensating valve 10 is arranged in the rear of the reversing valve 13. The oil inlet passage 4 is connected with the oil inlet P of the reversing valve 13; the oil port P' of the reversing valve 13 is connected with the oil inlet of the check valve 12; the oil outlet of the check valve 12 is connected with the oil inlet A of the electronic pressure compensating valve 10 and the second control chamber $P_E$ of the electronic pressure compensating valve 10; the first control chamber $P_F$ of the electronic pressure compensating valve 10 is directly connected with the oil detection passage 6; the oil detection passage 6 is connected with the oil detection opening F of the reversing valve 13 and the oil outlet B of the electronic pressure compensating valve 10 through the shuttle valve 11; the oil outlet T of the reversing valve 13 is connected with the oil return passage 7; working ports C, D of the reversing valve 13 are respectively connected with the oil inlet of the first one-way overflow valve 14, the oil inlet of the second one-way overflow valve 15, and two working ports of the actuator 16; and the oil outlets of the first one-way overflow valve 14 and the second one-way overflow valve 15 are connected with the oil return passage 7.

The electronic pressure compensating valve 10 is a proportional electromagnet 18 controlled pressure compensating valve or a linear motor 22 controlled pressure compensating valve or a rotating motor 23 driven and ball screw 24 controlled pressure compensating valve.

When the electronic pressure compensating valve 10 is a proportional electromagnet 18 controlled pressure compensating valve, it includes a displacement sensor 17, a proportional electromagnet 18, a compensating valve body 19, a compensating valve core 20, a spring 21, an oil inlet A, an oil outlet B, a first control chamber $P_F$, and a second control chamber $P_E$. The compensating valve core 20 is arranged in the compensating valve body 19; one end of the spring 21 acts on a left end face C of the compensating valve core 20, and the other end acts on the compensating valve body 19 and forms the first control chamber $P_F$ with the compensating valve core 20; the proportional electromagnet 18 is connected with the compensating valve body 19, acts on a right end face D of the compensating valve core 20, and forms the second control chamber $P_E$ with the compensating valve core 20 and the compensating valve body 19; and the displacement sensor 17 is integrated with the proportional electromagnet 18, and signal terminals of the proportional electromagnet 18 and the displacement sensor 17 are respectively connected with the controller 9.

When the electronic pressure compensating valve 10 is a linear motor 22 controlled pressure compensating valve, it includes a displacement sensor 17, a compensating valve body 19, a compensating valve core 20, a spring 21, a linear motor 22, an oil inlet A, an oil outlet B, a first control chamber $P_F$, and a second control chamber $P_E$. The compensating valve core 20 is arranged in the compensating valve body 19; one end of the spring 21 acts on a left end face C of the compensating valve core 20, and the other end acts on the compensating valve body 19 and forms the first control chamber $P_F$ with the compensating valve core 20; the displacement sensor 17 is disposed on the compensating valve core 20 through the compensating valve body 19 to directly detect a position X and a velocity XV of the valve core; the linear motor 22 is connected with the compensating valve body 19, is disposed on a right end face D of the compensating valve core 20, and forms the second control chamber $P_E$ with the compensating valve body 19 and the compensating valve core 20; and signal terminals of the displacement sensor 17 and the linear motor 22 are respectively connected with the controller 9.

When the electronic pressure compensating valve 10 is a rotating motor 23 driven and ball screw 24 controlled pressure compensating valve, it includes a displacement sensor 17, a compensating valve body 19, a compensating valve core 20, a spring 21, a rotating motor 23, a ball screw 24, a connecting rod 25, an oil inlet A, an oil outlet B, a first control chamber $P_F$, and a second control chamber $P_E$. The compensating valve core 20 is arranged in the compensating valve body 19; one end of the spring 21 acts on a left end face C of the compensating valve core 20, and the other end acts on the compensating valve body 19 and forms the first control chamber $P_F$ with the compensating valve core 20; the displacement sensor 17 is disposed on the compensating valve core 20 through the compensating valve body 19 to directly detect a position X and a velocity XV of the valve core; the rotating motor 23 is connected with the compensating valve body 19 and forms the second control chamber $P_E$ with the compensating valve body 19 and the compensating valve core 20; an extension shaft of the rotating motor 23 is connected with a screw of the ball screw 24, and a nut of the ball screw 24 is connected with the connecting rod 25; the rotating motor 23 drives the ball screw 24 to rotate, where the rotary motion of the motor is converted into a linear motion by the ball screw 24, thereby driving the connecting rod 25 to output different forces and displacements; and signal terminals of the displacement sensor 17 and the rotating motor 23 are respectively connected with the controller 9.

The electronic pressure compensating valve 10 is one of a normally open type or a normally closed type.

The displacement sensor 17 is integrated on the proportional electromagnet 18, and detects the position X and the velocity XV of the valve core by detecting the proportional electromagnet 18; or is disposed on the compensating valve core 20 to directly detect the position X and the velocity XV of the valve core.

The proportional electromagnet 18 is one of a unidirectional proportional electromagnet or a bidirectional proportional electromagnet.

The rotating motor 23 is one of a DC motor, a synchronous motor, or an asynchronous motor.

The main hydraulic pump 2 is an electronic proportional variable displacement pump.

The power source 1 is one of an engine or an electric motor.

The reversing valve 13 is one of an electronic proportional reversing valve, a hydraulically controlled reversing valve, or an electro-hydraulic controlled reversing valve.

The actuator 16 is one of a hydraulic cylinder or a hydraulic motor.

Implementation of the working principles and different control methods of the system:

When the system is under the working condition of pressure over-load or flow saturation, the controller 9 matches the corresponding control strategy according to different parameters of the system to control the electronic pressure compensating valve 10, changes the compensation differential pressure of the electronic pressure compensating valve 10, and achieves the flow distribution as required under the working condition of flow saturation and pressure over-load.

When the main hydraulic pump 2 is a mechanical load-sensitive pump, the system has low cost and simple structure; and the oil detection passage 6 directly introduces a load pressure signal into the control chamber of the mechanical load-sensitive pump, to realize load-sensitive control of the system. However, when the oil detection passage 6 is excessively long, it causes delay on transmitting the pressure signal, and the system has problems of response lag and poor stability.

When the main hydraulic pump 2 is an electronic proportional pressure pump, the second pressure sensor 27 converts the load pressure signal of the oil detection passage 6 into an electrical signal for rapid transmission, thereby controlling the output pressure of the electronic proportional pressure pump to realize load-sensitive control of the system and effectively improving the dynamic characteristics of the system.

When the main hydraulic pump 2 is an electronic proportional variable displacement pump, load-sensitive differential pressure control and flow matching control can be realized. For the load-sensitive control, the first pressure sensor 26 and the second pressure sensor 27 respectively detect the outlet pressure and the maximum load pressure of the main hydraulic pump 2, and control the displacement of the main hydraulic pump 2, so that the displacement of the main hydraulic pump 2 is always a constant value higher than the highest load pressure, to achieve follow-up control of the pump outlet pressure and load pressure. For the flow matching control, the opening degree of each electronic pressure compensating valve 10 is detected by the displacement sensor 17 and is compared with a maximum theoretical opening degree; then, the displacement of the main hydraulic pump 2 is controlled so that any one of the electronic pressure compensating valves 10 is fully open; and at this time, the output flow of the pump is consistent with the load demand, where pressure control that is prone to vibration is converted into the position control of the pump swing angle and finally converted into precise closed-loop control of the pump output flow, thereby realizing accurate supply of hydraulic pump flow.

The foregoing description is only illustrative of several embodiments of the present invention, and the specific and detailed description is not to be construed as limiting the scope of the present invention. The present invention is not limited to an excavator, and can be applied to other multi-actuator engineering machinery such as a loader, a crane, and a telehandler.

What is claimed is:

1. An engineering machinery hydraulic system, comprising a power source, a main hydraulic pump, an overflow valve, an oil inlet passage, an overflow detection valve, an oil detection passage, an oil return passage, and a plurality of work connections, wherein the power source drives the main hydraulic pump to operate, an oil outlet of the main hydraulic pump is connected with the oil inlet passage and an oil inlet of the overflow valve, an oil outlet of the overflow valve is connected with an oil tank, the plurality of work connections are respectively connected with the oil inlet passage, the oil return passage and the oil detection passage, the oil detection passage is connected with the oil return passage through the overflow detection valve, and the oil return passage is connected with the oil tank;

further comprising a controller, an electronic pressure compensating valve, a first pressure sensor, and a second pressure sensor, wherein a pressure end of the first pressure sensor is connected with the oil inlet passage, a pressure end of the second pressure sensor is connected with the oil detection passage, and signal terminals of the first pressure sensor and the second pressure sensor are respectively connected with the controller; and the electronic pressure compensating valve is:

a proportional electromagnet controlled pressure compensating valve, comprising a displacement sensor, a proportional electromagnet, a compensating valve body, a compensating valve core, a spring, an oil inlet, an oil outlet, a first control chamber, and a second control chamber, wherein the compensating valve core is arranged in the compensating valve body; a first end of the spring acts on a left end face of the compensating valve core, and a second end of the spring acts on the compensating valve body and forms the first control chamber with the compensating valve core; the proportional electromagnet is connected with the compensating valve body, acts on a right end face of the compensating valve core, and forms the second control chamber with the compensating valve core and the compensating valve body; the displacement sensor is integrated with the proportional electromagnet, and signal terminals of the proportional electromagnet and the displacement sensor are respectively connected with the controller; or a linear motor controlled pressure compensating valve, comprising a displacement sensor, a compensating valve body, a compensating valve core, a spring, a linear motor, an oil inlet, an oil outlet, a first control chamber, and a second control chamber, wherein the compensating valve core is arranged in the compensating valve body; a first end of the spring acts on a left end face of the compensating valve core, and a second end of the spring acts on the compensating valve body and forms the first control chamber with the compensating valve core; the displacement sensor is disposed on the compensating valve core through the compensating valve body to directly detect a position and a velocity of the compensating valve core; the linear motor is connected with the compensating valve body, is disposed on a right end face of the compensating valve core, and forms the second control chamber with the compensating valve body and the compensating valve core; and signal terminals of the displacement sensor and the linear motor are respectively connected with the controller; or a rotating motor driven and ball screw controlled pressure compensating valve, comprising a displacement sensor, a compensating valve body, a compensating valve core, a spring, a rotating motor, a ball screw, a connecting rod, an oil inlet, an oil outlet, a first control chamber, and a second control chamber, wherein the compensating valve core is arranged in the compensating valve body; a first end of the spring acts on a left end face of the compensating valve core, and a second end of the spring acts on the compensating valve body and forms the first control chamber with the compensating valve core; the displacement sensor is disposed on the compensating valve core through the compensating valve body to directly detect a position and a velocity of the compensating valve core; the rotating motor is connected with the compensating valve body and forms the second control chamber with the compensating valve body and the compensating valve core; an extension shaft of the rotating motor is connected with a screw of the ball screw, and a nut of the ball screw is connected with the connecting rod; the rotating motor drives the ball screw to rotate, where rotary motion of the rotating motor is converted into a linear motion by the ball screw, thereby driving the connecting rod to output different forces and displacements; and signal terminals of the displacement sensor and the rotating motor are respectively connected with the controller; and a connection manner between the electronic pressure compensating valve and the engineering machinery hydraulic system is as follows:

the electronic pressure compensating valve is arranged in the plurality of work connections and arranged in front of a reversing valve; the oil inlet of the electronic pressure compensating valve is connected with the oil inlet passage, the oil outlet of the electronic pressure compensating valve is connected with an oil inlet of a check valve and the second control chamber of the electronic pressure compensating valve, and the first control chamber of the electronic pressure compensating valve is connected with an oil detection opening of the reversing valve and connected with the oil detection passage through a shuttle valve; or the electronic pressure compensating valve is arranged in the plurality of work connections and arranged in rear of a reversing valve; an oil outlet of a check valve is connected with the oil inlet of the electronic pressure compensating valve and the second control chamber of the electronic pressure compensating valve, and the first control chamber of the electronic pressure compensating valve is directly connected with the oil detection passage; or the oil inlet of the electronic pressure compensating valve is directly connected with the oil outlet of the main hydraulic pump and the second control chamber of the electronic pressure compensating valve, the oil outlet of the electronic pressure compensating valve is connected with the oil tank, and the first control chamber of the electronic pressure compensating valve is directly connected with the oil detection passage.

2. The engineering machinery hydraulic system according to claim 1, wherein the electronic pressure compensating valve is one of a normally open type or a normally closed type.

3. The engineering machinery hydraulic system according to claim 1, wherein the displacement sensor is integrated on the proportional electromagnet, and the position and the velocity of the compensating valve core are detected by detecting the proportional electromagnet; or the displacement sensor is disposed on the compensating valve core to directly detect the position and the velocity of the compensating valve core.

4. The engineering machinery hydraulic system according to claim 1, wherein the proportional electromagnet is one of a unidirectional proportional electromagnet or a bidirectional proportional electromagnet.

5. The engineering machinery hydraulic system according to claim 1, wherein the rotating motor is one of a direct current (DC) motor, a synchronous motor, or an asynchronous motor.

6. The engineering machinery hydraulic system according to claim 1, wherein the main hydraulic pump is one of a mechanical load-sensitive pump, an electronic proportional pressure pump, or an electronic proportional variable displacement pump.

7. The engineering machinery hydraulic system according to claim 1, wherein the power source is one of an engine or an electric motor.

8. The engineering machinery hydraulic system according to claim 1, wherein the reversing valve is one of an electronic proportional reversing valve, a hydraulically controlled reversing valve, or an electro-hydraulic controlled reversing valve.

9. The engineering machinery hydraulic system according to claim 1, wherein working ports of the reversing valve are respectively connected with two working ports of an actuator, the actuator is one of a hydraulic cylinder or a hydraulic motor.

10. The engineering machinery hydraulic system according to claim 1, wherein the engineering machinery hydraulic system comprises a plurality of oil inlet passages, and the plurality of oil inlet passages are in communication with each other through a confluence control valve to perform shunt and confluence control.

11. An engineering machinery hydraulic system, comprising a power source, a main hydraulic pump, an overflow valve, an oil inlet passage, an overflow detection valve, an oil detection passage, an oil return passage, and a plurality of work connections, wherein the power source drives the main hydraulic pump to operate, an oil outlet of the main hydraulic pump is connected with the oil inlet passage and an oil inlet of the overflow valve, an oil outlet of the overflow valve is connected with an oil tank, the plurality of work connections are respectively connected with the oil inlet passage, the oil return passage and the oil detection passage, the oil detection passage is connected with the oil return passage through the overflow detection valve, and the oil return passage is connected with the oil tank;

further comprising a controller, an electronic pressure compensating valve, a first pressure sensor, and a second pressure sensor, wherein a pressure end of the first pressure sensor is connected with the oil inlet passage, a pressure end of the second pressure sensor is connected with the oil detection passage, and signal terminals of the first pressure sensor and the second pressure sensor are respectively connected with the controller; and the electronic pressure compensating valve is:

a proportional electromagnet controlled pressure compensating valve, comprising a displacement sensor, a proportional electromagnet, a compensating valve body, a compensating valve core, a spring, an oil inlet, an oil outlet, a first control chamber, and a second control chamber, wherein the compensating valve core is arranged in the compensating valve body; a first end of the spring acts on a left end face of the compensating valve core, and a second end of the spring acts on the compensating valve body and forms the first control chamber with the compensating valve core; the proportional electromagnet is connected with the compensating valve body, acts on a right end face of the compensating valve core, and forms the second control chamber with the compensating valve core and the compensating valve body; the displacement sensor is integrated with the proportional electromagnet, and signal terminals of the proportional electromagnet and the displacement sensor are respectively connected with the controller; or a linear motor controlled pressure compensating valve, comprising a displacement sensor, a compensating valve body, a compensating valve core, a spring, a linear motor, an oil inlet, an oil outlet, a first control chamber and a second control chamber, wherein the compensating valve core is arranged in the compensating valve body; a first end of the spring acts on a left end face of the compensating valve core, and a second end of the spring acts on the compensating valve body and forms the first control chamber with the compensating valve core; the displacement sensor is disposed on the compensating valve core through the compensating valve body to directly detect a position and a velocity of the compensating valve core; the linear motor is connected with the compensating valve body, is disposed on a right end face of the compensating valve core, and forms the second control chamber with the compensating valve body and the compensating valve core; and signal terminals of the displacement sensor and the linear motor are respectively connected with the controller; or a rotating motor driven and ball screw controlled pressure compensating valve, comprising a displacement sensor, a compensating valve body, a compensating valve core, a spring, a rotating motor, a ball screw, a connecting rod, an oil inlet, an oil outlet, a first control chamber, and a second control chamber, wherein the compensating valve core is arranged in the compensating valve body; a first end of the spring acts on a left end face of the compensating valve core, and a second end of the spring acts on the compensating valve body and forms the first control chamber with the compensating valve core; the displacement sensor is disposed on the compensating valve core through the compensating valve body to directly detect a position and a velocity of the compensating valve core; the rotating motor is connected with the compensating valve body and forms the second control chamber with the compensating valve body and the compensating valve core; an extension shaft of the rotating motor is connected with a screw of the ball screw, and a nut of the ball screw is connected with the connecting rod; the rotating motor drives the ball screw to rotate, where rotary motion of the rotating motor is converted into a linear motion by the ball screw, thereby driving the connecting rod to output different forces and displacements; and signal terminals of the displacement sensor and the rotating motor are respectively connected with the controller; and a connection manner between the electronic pressure compensating valve and the engineering machinery hydraulic system is as follows:

the electronic pressure compensating valve is arranged in the plurality of work connections and arranged in front of a reversing valve; the oil inlet of the electronic pressure compensating valve is connected with the oil inlet passage, the oil outlet of the electronic pressure compensating valve is connected with an oil inlet of a check valve and the second control chamber of the electronic pressure compensating valve, and the first control chamber of the electronic pressure compensating valve is connected with an oil detection opening of the reversing valve and connected with the oil detection passage through a shuttle valve; or the electronic pressure compensating valve is arranged in the plurality of work connections and arranged in rear of a reversing valve; an oil outlet of a check valve is connected with the oil inlet of the electronic pressure compensating valve and the second control chamber of the electronic pressure compensating valve, and the first control chamber of the electronic pressure compensating valve is directly connected with the oil detection passage.

12. An engineering machinery hydraulic system, comprising a power source, a main hydraulic pump, an overflow valve, an oil inlet passage, an overflow detection valve, an oil detection passage, an oil return passage, and a plurality of work connections, wherein the power source drives the main hydraulic pump to operate, an oil outlet of the main hydraulic pump is connected with the oil inlet passage and an oil inlet of the overflow valve, an oil outlet of the overflow valve is connected with an oil tank, the plurality of work connections are respectively connected with the oil inlet passage, the oil return passage and the oil detection passage, the oil detection passage is connected with the oil return passage through the overflow detection valve, and the oil return passage is connected with the oil tank;

further comprising a controller, an electronic pressure compensating valve, and a plurality of oil inlet passages, wherein the plurality of oil inlet passages are in communication with each other through a confluence control valve to perform shunt and confluence control and the electronic pressure compensating valve is:

a proportional electromagnet controlled pressure compensating valve, comprising a displacement sensor, a proportional electromagnet, a compensating valve body, a compensating valve core, a spring, an oil inlet, an oil outlet, a first control chamber, and a second control chamber, wherein the compensating valve core is arranged in the compensating valve body; a first end of the spring acts on a left end face of the compensating valve core, and a second end of the spring acts on the compensating valve body and forms the first control chamber with the compensating valve core; the proportional electromagnet is connected with the compensating valve body, acts on a right end face of the compensating valve core, and forms the second control chamber with the compensating valve core and the compensating valve body; the displacement sensor is integrated with the proportional electromagnet, and signal terminals of the proportional electromagnet and the displacement sensor are respectively connected with the controller; or a linear motor controlled pressure compensating valve, comprising a displacement sensor, a compensating valve body, a compensating valve core, a spring, a linear motor, an oil inlet, an oil outlet, a first control chamber, and a second control chamber, wherein the compensating valve core is arranged in the compensating valve body; a first end of the spring acts on a left end face of the compensating valve core, and a second end of the spring acts on the compensating valve body and forms the first control chamber with the compensating valve core; the displacement sensor is disposed on the compensating valve core through the compensating valve body to directly detect a position and a velocity of the compensating valve core; the linear motor is connected with the compensating valve body, is disposed on a right end face of the compensating valve core, and forms the second control chamber with the compensating valve body and the compensating valve core; and signal terminals of the displacement sensor and the linear motor are respectively connected with the controller; or a rotating motor driven and ball screw controlled pressure compensating valve, comprising a displacement sensor, a compensating valve body, a compensating valve core, a spring, a rotating motor, a ball screw, a connecting rod, an oil inlet, an oil outlet, a first control chamber, and a second control chamber, wherein the compensating valve core is arranged in the compensating valve body; a first end of the spring acts on a left end face of the compensating valve core, and a second end of the spring acts on the compensating valve body and forms the first control chamber with the compensating valve core; the displacement sensor is disposed on the compensating valve core through the compensating valve body to directly detect a position and a velocity of the compensating valve core; the rotating motor is connected with the compensating valve body and forms the second control chamber with the compensating valve body and the compensating valve core; an extension shaft of the rotating motor is connected with a screw of the ball screw, and a nut of the ball screw is connected with the connecting rod; the rotating motor drives the ball screw to rotate, where rotary motion of the rotating motor is converted into a linear motion by the ball screw, thereby driving the connecting rod to output different forces and displacements; and signal terminals of the displacement sensor and the rotating motor are respectively connected with the controller; and a connection manner between the electronic pressure compensating valve and the engineering machinery hydraulic system is as follows:

the electronic pressure compensating valve is arranged in the plurality of work connections and arranged in front of a reversing valve; the oil inlet of the electronic pressure compensating valve is connected with the oil inlet passage, the oil outlet of the electronic pressure compensating valve is connected with an oil inlet of a check valve and the second control chamber of the electronic pressure compensating valve, and the first control chamber of the electronic pressure compensating valve is connected with an oil detection opening of the reversing valve and connected with the oil detection passage through a shuttle valve; or the electronic pressure compensating valve is arranged in the plurality of work connections and arranged in rear of a reversing valve; an oil outlet of a check valve is connected with the oil inlet of the electronic pressure compensating valve and the second control chamber of the electronic pressure compensating valve, and the first control chamber of the electronic pressure compensating valve is directly connected with the oil detection passage; or the oil inlet of the electronic pressure compensating valve is directly connected with the oil outlet of the main hydraulic pump and the second control chamber of the electronic pressure compensating valve, the oil outlet of the electronic pressure compensating valve is connected with the oil tank, and the first control chamber of the electronic pressure compensating valve is directly connected with the oil detection passage.

* * * * *